United States Patent [19]

Hattori

[11] Patent Number: 4,596,912

[45] Date of Patent: Jun. 24, 1986

[54] PUSH-BUTTON SWITCH

[75] Inventor: Yoichi Hattori, Iwaki, Japan

[73] Assignee: Alps Electric Co., Ltd., Japan

[21] Appl. No.: 703,297

[22] Filed: Feb. 20, 1985

[30] Foreign Application Priority Data

Feb. 20, 1984 [JP] Japan ..... 59-23357[U]

[51] Int. Cl.[4] ..... H01H 13/06

[52] U.S. Cl. ..... 200/302.2; 200/340; 200/159 B

[58] Field of Search ..... 200/340, 5 A, 159 B, 200/159 R, 160, 159 A, 302.2; 400/490, 491, 491.2, 495, 495.1

[56] References Cited

U.S. PATENT DOCUMENTS

| | | | |
|---|---|---|---|
| 3,731,014 | 5/1973 | Brady | 200/5 A |
| 3,937,913 | 2/1976 | Soulas et al. | 200/340 |
| 4,452,061 | 6/1984 | Tamura | 200/159 B |

FOREIGN PATENT DOCUMENTS

| | | | |
|---|---|---|---|
| 3041470 | 9/1982 | Fed. Rep. of Germany | 200/159 B |

OTHER PUBLICATIONS

IBM Technical Disclosure Bulletin, R. J. Wolfrom, Adjustable Key Force Control, vol. 18, No. 10, Mar. 1976.

*Primary Examiner*—Stephen Marcus
*Assistant Examiner*—Linda J. Sholl
*Attorney, Agent, or Firm*—Guy W. Shoup

EXEMPLARY CLAIM

A push-button switch for use in the keyboard of an electronic typewriter, word processor, or the like comprises a casing, a stem extending through the casing for operating a movable contact, a top cover mounted on the outer end of the stem, a cylinder of an elastomeric material disposed between the top cover and the casing and loosely mounted on the outer periphery of the stem, and a circular retaining plate protruding from the outer end of the stem. The cylinder which biases the stem upward is resiliently mounted between the retaining plate and the casing, whereby the cylinder is maintained in a fixed condition.

1 Claim, 4 Drawing Figures

PUSH-BUTTON SWITCH

FIELD OF THE INVENTION

The present invention relates to a push-button switch for use in the keyboard of an electronic typewriter, word processor, electronic computer, or other similar device.

BACKGROUND OF THE INVENTION

A known push-button switch of this kind is shown in FIG. 1, and is comprised of a casing 1 having an open lower end with a printed circuit board 2 serving as the base of the switch. A stem 3 extends through the top wall of the casing 1, and a block 4 of sponge material is fixedly secured to the inner end of the stem 3. A circular movable contact 5 is firmly fixed to the lower end of the block 4 of the sponge, and fixed contacts 6 and 7 are disposed on the printed circuit board 2 in a position opposite to the movable contact 5. A top cover 9 is provided over the stem 3, and a rectangular shaft 10 extends downwardly from the center of the top cover 9 into a recess 8 of the stem 3. An elastomeric cylinder 11 of rubber or the like is disposed between the casing 1 and the top cover 9 and is loosely mounted on the periphery of the stem 3. The cylinder acts to bias the stem 3 upwardly when depressed. The casing 1 is rigidly fixed to the printed circuit board 2.

In the operation of the conventional push-button switch constructed as described above, when the top cover 9 is depressed against the resilience of the cylinder 11 of rubber, the stem 3 is shifted downward to cause the movable contact 5 to bear on the fixed contacts 6 and 7, thus closing the circuit. When the depressing force exerted on the cover 9 is released, the resilience of the rubber cylinder 11 restores the top cover 9 to its original state. At the same time, the movable contact 5 is disengaged from the fixed contacts 6 and 7, whereby the circuit is opened.

In the prior art push-button switch as mentioned above, a gap of dimension a may be produced between the top cover 9 and the rubber cylinder 11 while the switch is being assembled. In this case, the cylinder 11 is free to move vertically and from side to side, creating an undesirable situation.

In an attempt to remove this difficulty, another push-button switch shown in FIG. 2 has been proposed. The rubber cylinder 11 of this switch is provided with a flange 11*a* around its lower end, and the flange 11*a* is retained by a claw 12 mounted on the top end of the casing 1. This switch is capable of preventing the rubber cylinder 11 from vibrating up and down or from moving side to side, but it has a complicated shape resulting in increases in production efficiency.

SUMMARY OF THE INVENTION

Accordingly, it is the object of the present invention to provide a push-button switch in which a rubber cylinder is prevented from vibrating by a simple structure.

This object is achieved by a push-button switch having a casing, a stem, a retaining portion protruding from the outer end of the stem, and a cylinder of rubber resiliently mounted between the retaining portion and the casing.

DETAILED DESCRIPTION OF THE INVENTION

Figure 1:
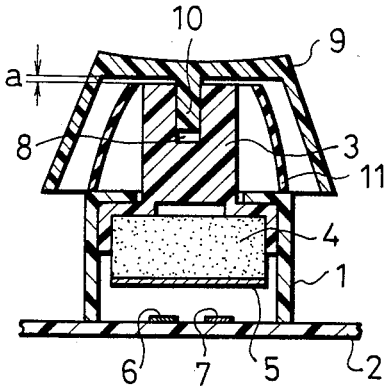
Fig.1 PRIOR ART
FIG. 1 is a cross-sectional view of a conventional push-button switch.
Figure 2:
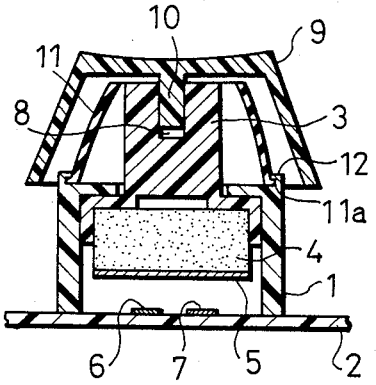
Fig.2 PRIOR ART
FIG. 2 is a cross-sectional view of another conventional push-button switch.
Figure 3:
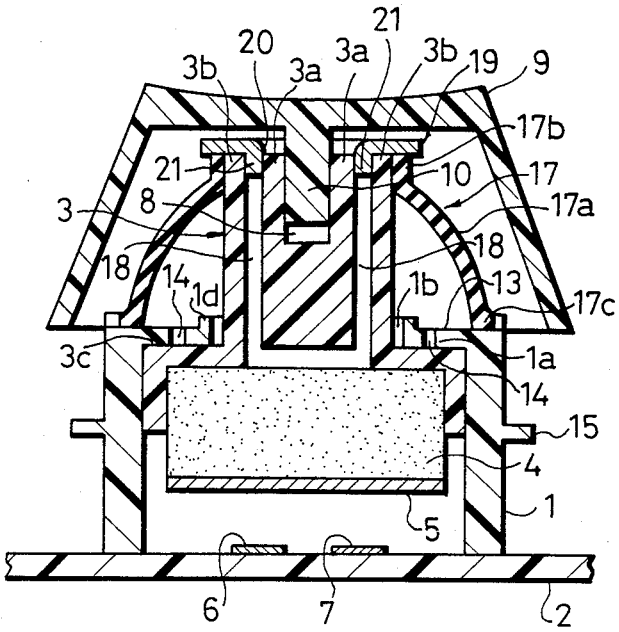
FIG. 3 is a cross-sectional view of a push-button switch according to the present invention.
Figure 4:
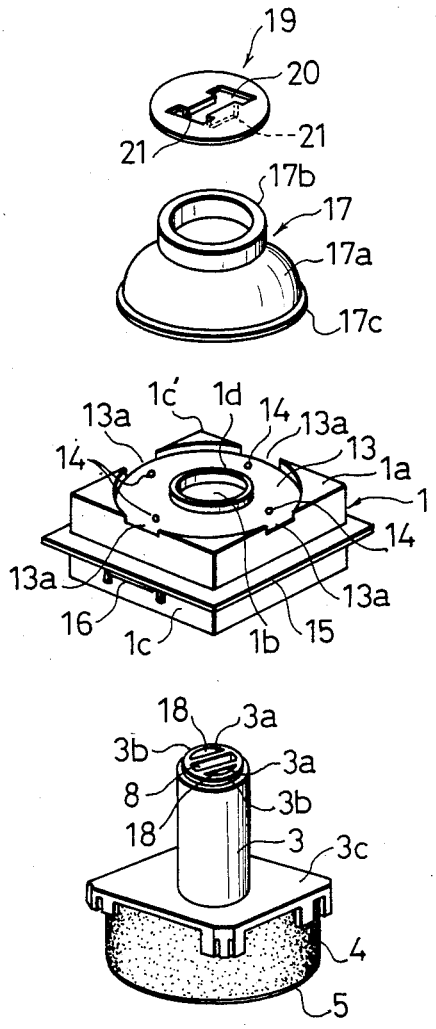
FIG. 4 is an exploded perspective view of the push-button switch of FIG. 3, and in which the top cover and the printed circuit board are omitted.

Referring to FIGS. 3 and 4, there is shown a push-button switch embodying the concept of the present invention. Those components of this switch shown in FIGS. 3 and 4 which are the same as those of the conventional switches shown in FIGS. 1 and 2 are indicated by the same reference numerals as in FIGS. 1 and 2, and will not be described below. The top wall 1*a* of the casing 1 of the switch of the present invention is provided with a circular recess 13 which is open at its upper end. Also, the top wall 1*a* is provided with a hole 1*b* through which the stem 3 extends. Each side of the upper end of the casing 1 is formed with a notch 13*a* through which the recess 13 is in communication with the outside. Air holes 14 extend through the top wall 1*a* of the casing 1 so that air can enter and leave the casing through these holes 14. Mounting flanges 15 protrude from the outer periphery of the casing 1. A flexible retaining element 16 is disposed on the lower portion of one side surface 1*c* of the casing 1. A cylindrical central wall 1*d* extends upwardly around the hole 1*b*. The lower portion of the retaining element 16 is formed integrally with the casing 1. A similar flexible retaining element (not shown) is also formed on the side surface 1*c*.

Referring specifically to FIG. 3, an elastomeric cylinder 17 of rubber or the like is loosely mounted on the outer periphery of the stem 3 between the top cover 9 and the top wall 1*a* of the casing 1. This cylinder 17 is comprised of a domelike enlarged portion 17*a*, a reduced tube portion 17*b* standing upright from the upper end of the opening of the enlarged portion 17*a*, and a thick-wall portion 17*c* formed on the lower end of the enlarged portion 17*a*, as shown in FIG. 4.

The stem 3 has axial holes 18 formed on opposite sides of the central opening 8. A circular retaining plate 19 is disposed on the outer end of the stem 3. A rectangular hole 20 is formed in the center of the retaining plate 19 so that the shaft 3 may pass through it. Mounting members 21 are formed oppositely on the longitudinal sides of the hole 20. The mounting members 21 extend perpendicularly to the surface of the retaining plate 19, which is secured to the outer end of the stem 3 by lightly urging the mounting members 21 into the holes 18. The outer portion of the retaining plate 19 protrudes outwardly from the periphery of the stem 3 for retaining purposes.

The aforementioned rubber cylinder 17 is resiliently mounted between the outer portion of the retaining plate 19 and the top wall 1*a* of the casing 1. Thus, the cylinder may not move vertically. The cylinder acts to bias the stem 3 upward. The reduced tubing 17*b* of the cylinder 17 fits over the outer periphery of the stem 3, and the thick-wall portion 17*c* fits in the recess in the casing 1. This keeps the cylinder 17 from moving from side to side. The mounting shaft 10 of the top cover 9 is inserted in the hole 8 with a press fit to deform the intermediate walls 3*a* between the hole 8 and the holes 18 laterally as viewed in FIG. 3. Thus, the mounting members 21 are held between their respective intermediate walls 3*a* and outer walls 3*b*, causing the retaining plate 19 to be more rigidly fixed to the stem 3. This stem 3 is provided with a flange 3*c* to prevent it from coming off.

In the operation of the novel push-button switch constructed as described above, when the top cover 9 is depressed to urge the stem 3 downward, the stem 3 moves the retaining plate 19 downward, deforming the intermediate portion of the enlarged portion 17*a* of the rubber cylinder 17. This causes the air inside the enlarged portion 17*a* to flow into a chamber formed between the top wall 1*a* of the casing 1 and the flange 3*c* of the stem 3 through the hole 1*b* and the air holes 14, thus preventing the thick-wall portion 17*c* located below the enlarged portion 17*a* from disengaging from the recess 13.

Then, the top cover 9 is depressed further to bend the enlarged portion 17*a* of the rubber cylinder 17 further such that the cylinder 17 inverts inwardly as is well understood in the art. At this time, the human operator feels this operation through the top cover 9. The result is that the movable contact 5 makes contact with the fixed contacts 6 and 7 at the same time, closing the circuit.

When the depressing force applied to the top cover 9 is released, the resilience of the rubber cylinder 17 restores the top cover 9, the stem 3, the sponge 4, the movable contact 5, and other parts to their original state, opening the circuit. At this time, the air between flange 3*c* of the stem 3 and the top wall 1*a* of the casing 1 is caused to flow to the inside of the enlarged portion 17*a* of the cylinder 17 through the hole 1*b* and the air holes 14.

When the top cover 9 is removed from the stem 3, the stem 3 is also held in the casing 1. Accordingly, there arises no possibility that the stem 3 comes off the casing 1.

As thus far described, the push-button comprises the retaining portion protruding from the outer end of the stem and the rubber cylinder is resiliently mounted between the retaining portion and the casing. Thus, only a simple structure is necessary to prevent the rubber cylinder from moving vertically and from side to side. Further, even when the top cover is removed from the stem, the above-described structure keeps the stem from coming off the casing. Consequently, the stem is not required to have an anchoring portion that directly engages the casing to prevent the stem from coming off.

What is claimed is:

1. A push-button switch comprising:

a casing;

a stem extending through the casing and acting to operate a contact;

a top cover mounted on the outer end of the stem;

a cyliner of rubber disposed between the top cover and the casing for biasing the stem, the cylinder being loosely mounted on the outer periphery of the stem; and a retaining means protruding from the outer end of the stem, the retaining means being a circular plate having downwardly extending portions which are fitted in holes formed in the stem, the cylinder being resiliently mounted between the retaining means and the casing.

* * * * *